US009475013B2

(12) United States Patent
Abate et al.

(10) Patent No.: US 9,475,013 B2
(45) Date of Patent: Oct. 25, 2016

(54) DROPLET FORMATION USING FLUID BREAKUP

(71) Applicant: President and Fellows of Harvard College, Cambridge, MA (US)

(72) Inventors: Adam R. Abate, San Francisco, CA (US); David A. Weitz, Bolton, MA (US)

(73) Assignee: President and Fellows of Harvard College, Cambridge, MA (US)

( * ) Notice: Subject to any disclaimer, the term of this patent is extended or adjusted under 35 U.S.C. 154(b) by 36 days.

(21) Appl. No.: 14/377,267
(22) PCT Filed: Feb. 7, 2013

(86) PCT No.: PCT/US2013/025058

§ 371 (c)(1),
(2) Date: Aug. 7, 2014

(87) PCT Pub. No.: WO2013/119753

PCT Pub. Date: Aug. 15, 2013

(65) Prior Publication Data

US 2015/0034163 A1 Feb. 5, 2015

Related U.S. Application Data

(60) Provisional application No. 61/596,658, filed on Feb. 8, 2012.

(51) Int. Cl.
*B01F 3/00* (2006.01)
*B01F 3/08* (2006.01)
(Continued)

(52) U.S. Cl.
CPC ..... *B01F 3/0803* (2013.01); *B01F 3/0807* (2013.01); *B01F 3/0865* (2013.01);
(Continued)

(58) Field of Classification Search
CPC B01F 13/0059; B01F 3/0803; B01F 3/0807; B01F 3/0865; B01F 5/0471; Y10T 137/0318; Y10T 137/87587; B01L 3/50273; B01L 3/502776; B01L 3/502784; B01L 3/0241; B01L 2200/0673
See application file for complete search history.

(56) References Cited

U.S. PATENT DOCUMENTS 5,888,538 A 3/1999 Kiefer et al.
6,911,183 B1 6/2005 Handique et al.
(Continued)

FOREIGN PATENT DOCUMENTS

CN 101300352 A 11/2008
CN 102014871 A 4/2011
(Continued)

OTHER PUBLICATIONS

U.S. Appl. 13/979,984, filed Oct. 2, 2013, Abate et al.
(Continued)

*Primary Examiner* — Jennifer Wecker
(74) *Attorney, Agent, or Firm* — Wolf, Greenfield & Sacks, P.C.

(57) ABSTRACT

The present invention generally relates to systems and methods for creating droplets. In one aspect, a plurality of droplets (27) is introduced into a continuous fluid stream (21) to cause the continuous fluid stream to form discrete droplets. In some cases, the droplets that are formed from the continuous fluid stream may be substantially monodisperse. The continuous fluid stream may, in some cases, be a jetting fluid stream flowing at a relatively high linear flow rate, and in certain embodiments, high rates of droplet formation from the jetting fluid may thereby be achieved. Additionally, certain aspects of the invention are generally directed to devices, such as microfluidic devices, able to form such droplets. For example, in one set of embodiments, a device may include a junction (14) where a plurality of droplets (27) can be introduced into a continuous fluid stream (21), and optionally, the device may include additional junctions (12) able to cause the formation of the plurality of droplets and/or the formation of the continuous fluid stream. Still other disclosed aspects are generally directed to methods of making such devices, methods of using such devices, kits involving such devices, and the like.

18 Claims, 3 Drawing Sheets

(51) Int. Cl.

| | |
|---|---|
| ***B01F 5/04*** | (2006.01) |
| ***B01F 13/00*** | (2006.01) |
| *B01F 5/00* | (2006.01) |
| *B01F 5/02* | (2006.01) |
| *B01L 3/00* | (2006.01) |
| *B01L 3/02* | (2006.01) |

(52) U.S. Cl.

CPC ..... *B01F5/0471* (2013.01); *B01F 13/0059* (2013.01); *B01F 5/0085* (2013.01); *B01L 3/0241* (2013.01); *B01L 3/50273* (2013.01); *B01L 3/502776* (2013.01); *B01L 3/502784* (2013.01); *B01L 2200/0673* (2013.01); *Y10T 137/0318* (2015.04); *Y10T 137/87587* (2015.04)

(56) References Cited

U.S. PATENT DOCUMENTS

| | | | | |
|---|---|---|---|---|
| 7,691,331 | B2 | 4/2010 | Ajdari et al. | |
| 7,776,927 | B2 * | 8/2010 | Chu | A61K 9/113 347/55 |
| 8,871,444 | B2 | 10/2014 | Griffiths et al. | |
| 2002/0142482 | A1 | 10/2002 | Wu et al. | |
| 2006/0094119 | A1 | 5/2006 | Ismagilov et al. | |
| 2007/0003442 | A1 | 1/2007 | Link et al. | |
| 2007/0080976 | A1 | 4/2007 | Parng et al. | |
| 2007/0110631 | A1 | 5/2007 | Ajdari et al. | |
| 2007/0111303 | A1 | 5/2007 | Inoue et al. | |
| 2007/0264320 | A1 | 11/2007 | Lee et al. | |
| 2008/0003142 | A1 * | 1/2008 | Link | B01F 3/0807 422/82.08 |
| 2009/0131543 | A1 * | 5/2009 | Weitz | A61K 9/113 516/54 |
| 2010/0136544 | A1 * | 6/2010 | Agresti | C12Q 1/6834 435/287.2 |
| 2010/0238232 | A1 * | 9/2010 | Clarke | B41J 2/03 347/21 |
| 2011/0059556 | A1 | 3/2011 | Strey et al. | |
| 2011/0120562 | A1 | 5/2011 | Tan et al. | |
| 2011/0217736 | A1 * | 9/2011 | Hindson | C12P 19/34 435/91.2 |
| 2011/0262316 | A1 | 10/2011 | Inoue et al. | |
| 2012/0211084 | A1 | 8/2012 | Weitz et al. | |
| 2014/0026968 | A1 | 1/2014 | Abate et al. | |
| 2014/0179544 | A1 * | 6/2014 | Steenblock | B01L 3/502784 506/9 |
| 2015/0065396 | A1 | 3/2015 | Kiani et al. | |

FOREIGN PATENT DOCUMENTS

| | | | | |
|---|---|---|---|---|
| EP | 2 157 599 | A1 | 2/2010 | |
| EP | 2157599 | A1 * | 2/2010 | G01N 1/38 |
| JP | 2010-053053 | A | 3/2010 | |
| JP | 2010-058119 | A | 3/2010 | |
| WO | WO 01/88525 | A1 | 11/2001 | |
| WO | WO 2004/002627 | A2 | 1/2004 | |
| WO | WO 2004/091763 | A2 | 10/2004 | |
| WO | WO 2004/103565 | A2 | 12/2004 | |
| WO | WO 2005/021151 | A1 | 3/2005 | |
| WO | WO 2006/096571 | A2 | 9/2006 | |
| WO | WO 2007/089541 | A2 | 8/2007 | |
| WO | WO 2008/063135 | A1 | 5/2008 | |
| WO | WO 2010/009365 | A1 | 1/2010 | |
| WO | WO 2011/028764 | A2 | 3/2011 | |
| WO | WO 2011028764 | A2 * | 3/2011 | B01F 3/0807 |
| WO | WO 2011/116154 | A2 | 9/2011 | |
| WO | WO 2013/119753 | A1 | 8/2013 | |

OTHER PUBLICATIONS

PCT/US2012/023961, May 2, 2012, Invitation to Pay Additional Fees.

PCT/US2012/023961, Jul. 18, 2012, International Search Report and Written Opinion.

PCT/US2012/023961, Aug. 22, 2013, International Report on Patentability.

PCT/US2013/025058, May 2, 2013, International Search Report and Written Opinion.

PCT/US2013/025058, Aug. 21, 2014, International Preliminary Report on Patentability.

PCT/US2012/045481, Oct. 23, 20112, Invitation to Pay Additional Fees.

PCT/US2012/045481, Feb. 6, 2013, International Search Report and Written Opinion.

Chinese Office Action for Application No. 201280007426.9 mailed on Apr. 8, 2015.

Chinese Office Action for Application No. CN 201280007426.9 mailed Aug. 28, 2015.

Japanese Office Action mailed on Aug. 18, 2015 for Application No. 2013-552712.

European Office Action mailed on Jun. 4, 2015 for Application No. 13707733.5.

Invitation to Pay Additional Fees for Application No. PCT/US2012/023961 mailed May 2, 2012.

International Search Report and Written Opinion for Application No. PCT/US2012/023961 mailed Jul. 18, 2012.

International Report on Patentability for Application No. PCT/US2012/023961 mailed Aug. 22, 2013.

International Search Report and Written Opinion for Application No. PCT/US2013/025058 mailed May 2, 2013.

International Preliminary Report on Patentability mailed Aug. 21, 2014 for Application No. PCT/U52013/025058.

Invitation to Pay Additional Fees for Application No. PCT/US2012/045481 mailed Oct. 23, 2012.

International Search Report and Written Opinion for Application No. PCT/US2012/045481 mailed Feb. 6, 2013.

Abate et al. Air-bubble-triggered drop formation in microfluidics. Lab Chip. May 21, 2011;11(10):1713-16.

Utada et al., Dripping to jetting transitions in coflowing liquid streams. Physical Review Letters. 2007; 094502-1-094502-4.

Japanese Office Action mailed on Mar. 29, 2016 for Application No. JP 2013-552712.

* cited by examiner

DROPLET FORMATION USING FLUID BREAKUP

RELATED APPLICATIONS

This application claims the benefit of U.S. Provisional Patent Application Ser. No. 61/596,658, filed Feb. 8, 2012, entitled "Droplet Formation using Fluid Breakup," by Abate, et al., incorporated herein by reference in its entirety.

GOVERNMENT FUNDING

Research leading to various aspects of the present invention was sponsored, at least in part, by the National Science Foundation, Grant Nos. DBI-0649865 and DMR-0820484. The U.S. Government has certain rights in the invention.

FIELD OF INVENTION

The present invention generally relates to microfluidics and, in particular, to systems and methods for creating droplets.

BACKGROUND

The manipulation of fluids to form fluid streams of desired configuration, discontinuous fluid streams, droplets, particles, dispersions, etc., for purposes of fluid delivery, product manufacture, analysis, and the like, is a relatively well-studied art. Examples of methods of producing droplets in a microfluidic system include the use of T-junctions or flow-focusing techniques. However, such techniques often work only at relatively slow laminar or "dripping" conditions, and in some applications, faster rates of droplet production are needed, for instance, to produce larger numbers of droplets.

SUMMARY

The present invention generally relates to systems and methods for creating droplets. The subject matter of the present invention involves, in some cases, interrelated products, alternative solutions to a particular problem, and/or a plurality of different uses of one or more systems and/or articles.

In one aspect, the present invention is generally directed to a device for producing droplets. In one set of embodiments, the device comprises a first junction comprising a first inlet microfluidic channel, a second inlet microfluidic channel, and an outlet microfluidic channel. In some cases, the angle between the first channel and the second channel is less than about 45°. The device may also comprise a second junction upstream of the second channel of the second junction, where the second junction is configured and arranged to produce substantially monodisperse droplets of a first fluid in a second fluid.

In another set of embodiments, the device comprises a continuous jetting fluid stream comprising a first fluid, and a plurality of substantially monodisperse droplets of second fluid positioned to enter the fluid stream. The device, in accordance with another set of embodiments, includes a microfluidic channel comprising a continuous jetting fluid stream comprising a first fluid, and a plurality of droplets of second fluid positioned to enter the fluid stream.

In one set of embodiments, the device comprises a first junction comprising a first inlet microfluidic channel, a second inlet microfluidic channel, and an outlet microfluidic channel. In some cases, the angle between the first channel and the second channel is less than about 45°. The device may also include, in certain embodiments, a second junction upstream of the first channel of the first junction. For example, the second junction may be a T-junction, a flow-focus junction, or the like.

In another set of embodiments, the device may include a first, droplet-producing microfluidic junction, a second microfluidic junction for producing a jetting fluid, and a third junction positioned downstream of each of the first and second junctions.

In another aspect, the present invention is generally directed to a method of producing droplets. In one set of embodiments, the method includes acts of providing, in a microfluidic channel, a continuous fluid stream comprising a first fluid, and inserting a plurality of droplets of a second fluid into the continuous fluid stream to cause the continuous fluid stream to form discrete droplets of first fluid.

In another set of embodiments, the method includes acts of providing a continuous fluid stream comprising a first fluid, and inserting a plurality of droplets of second fluid into the continuous fluid stream to cause the continuous fluid stream to form discrete substantially monodisperse droplets of first fluid.

The method, in accordance with still another set of embodiments, includes acts of providing a continuous fluid stream comprising a first fluid, and inserting a plurality of substantially monodisperse droplets of second fluid into the continuous fluid stream to cause the continuous fluid stream to form discrete droplets of first fluid.

In one set of embodiments, the method includes acts of providing a continuous fluid stream comprising a first fluid, and inserting a plurality of droplets of second fluid into the continuous fluid stream to cause the continuous fluid stream to form droplets of first fluid.

The method, in accordance with another set of embodiments, includes an act of producing substantially monodisperse microfluidic droplets at a rate of at least about 15,000 droplets/s. In yet another set of embodiments, the method includes acts of providing a jetting continuous fluid stream contained within a microfluidic channel, and causing the fluid stream to form substantially monodisperse microfluidic droplets without substantially altering the linear flow rate of the fluid stream within the microfluidic channel.

In another aspect, the present invention encompasses methods of making one or more of the embodiments described herein. In still another aspect, the present invention encompasses methods of using one or more of the embodiments described herein.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1:
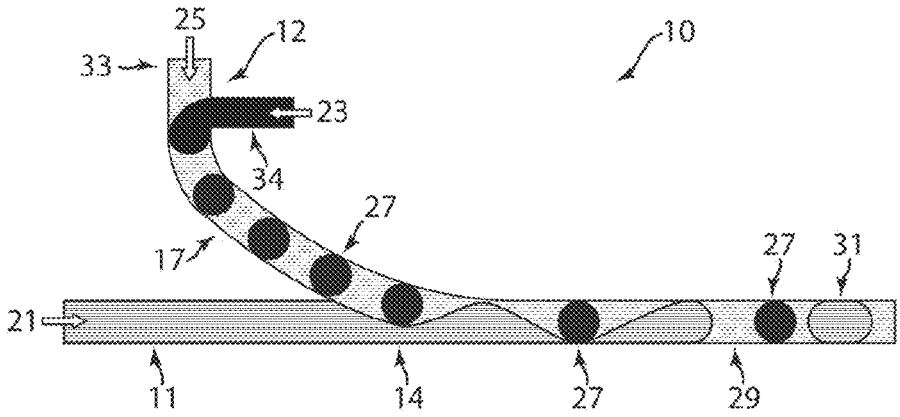
FIG. 1 is a schematic illustration of a droplet-producing system, in accordance with one embodiment of the invention.

The present invention generally relates to systems and methods for creating droplets. In one aspect, a plurality of droplets is introduced into a continuous fluid stream to cause the continuous fluid stream to form discrete droplets. In some cases, the droplets that are formed from the continuous fluid stream may be substantially monodisperse. The continuous fluid stream may, in some cases, be a jetting fluid stream flowing at a relatively high linear flow rate, and in certain embodiments, high rates of droplet formation from the jetting fluid may thereby be achieved. Additionally, certain aspects of the invention are generally directed to devices, such as microfluidic devices, able to form such droplets. For example, in one set of embodiments, a device may include a junction where a plurality of droplets can be introduced into a continuous fluid stream, and optionally, the device may include additional junctions able to cause the formation of the plurality of droplets and/or the formation of the continuous fluid stream. Still other aspects of the invention are generally directed to methods of making such devices, methods of using such devices, kits involving such devices, and the like.

Certain aspects of the present invention are generally directed to systems and methods for causing a continuous fluid stream to form discrete droplets. For example, referring now to the example shown in FIG. 1, a fluidic system 10 is shown including channel 11 containing a continuous stream of a first fluid 21. This fluid will subsequently be disrupted or dispersed to form discrete droplets, and can also be referred to as the "dispersable fluid." In some embodiments, first fluid 21 may be passed through channel 11 at flow rates such that first fluid 21 exhibits jetting behavior, or such that the first fluid has a Capillary number (Ca) of greater than about 1 and/or a Weber number (We) of less than about 1. Surprisingly, in some embodiments of the present invention, a fluid can be disrupted or dispersed to form separate discrete droplets of the fluid at relatively high flow rates, e.g., under conditions such that the fluid exhibits jetting behavior, and in some cases such that the discrete droplets of fluid that are formed are substantially monodisperse. For instance, such droplets of fluid may be produced at rates of about 15,000 droplets/s or more (although lower droplet production rates are also possible in other cases). In contrast, other systems and methods for creating substantially monodisperse droplets in a microfluidic channel typically cannot be operated under such conditions, and thus cannot be used to produce substantially monodisperse droplets at such high flow rates.

Referring again to FIG. 1, also shown is channel 17, which intersects channel 11 at junction 14. Fluid entering junction 14 may leave the junction through outlet channel 29. Channel 17 may contain droplets 27 of second fluid 23, contained in third fluid 25. As discussed below, after insertion, third fluid 25 will become the continuous phase while droplets 27 of second fluid 25 will be used to disrupt or disperse first fluid 21 from channel 11 to form discrete droplets of the first fluid contained within third fluid 25. Thus, second fluid 23 may also be referred to as the "insertion fluid," while third fluid 25 may also be referred to as the "continuous fluid." In some embodiments, the first and third fluids are substantially immiscible, and in some cases, the first, second, and third fluids are each substantially mutually immiscible. For example, first fluid 18 may be a hydrophobic liquid such as a fluorocarbon oil or another oil, third fluid 25 may be a hydrophilic liquid such as water or an aqueous solution, and second fluid 23 may be a gas such as air; or first fluid 18 may be a hydrophilic liquid, third fluid 25 may be a hydrophobic liquid, and second fluid 23 may be a gas such as air. Additional examples are discussed below.

As shown in FIG. 1, channel 17 delivers droplets or bubbles of second fluid 23 into junction 14, which are inserted into first fluid 21 from channel 11. In some cases, droplets 27 of second fluid 23 in channel 17 are substantially monodisperse, although they may not be in other cases. Insertion of droplets 27 into first fluid 21 entering from channel 11 disrupts or disperses first fluid 21, thereby causing first fluid 21 to break up to form discrete droplets 31. In outlet channel 29, droplets 31 of first fluid 21 may also be separated by droplets 27 of second fluid 23. In some embodiments, droplets 31 are substantially monodisperse.

As mentioned, within channel 17 are droplets 27 of second fluid 23 in third fluid 25. In some cases, droplets 27 are substantially monodisperse. These droplets may be produced using any suitable technique. For instance, as is shown in FIG. 1, T-junction 12 is used, where third fluid 25 enters the T-junction through channel 33 and second fluid 23 enters through channel 34 to produce droplets 27 (for example, due to shear forces, interfacial tension, hydrodynamic focusing, etc.) and exit junction 12 through channel 17. As another example (not shown in FIG. 1), junction 12 may be a flow-focusing junction.

The above discussion is a non-limiting example of an embodiment of the present invention that can be used to create droplets. However, other embodiments are also possible. Accordingly, more generally, various aspects of the invention are directed to various systems and methods for creating droplets, e.g., by inserting droplets or bubbles of a fluid into a continuous fluid stream to cause the continuous fluid stream to form discrete droplets. (As used herein, the term "fluid" generally refers to a substance that tends to flow and to conform to the outline of its container, i.e., a liquid, a gas, a viscoelastic fluid, etc.; if the fluid is a gas, a discrete droplet of that gas may also be referred to as a "bubble.") In some cases, such droplets may be produced in a device containing microfluidic channels, as is discussed below.

As previously noted, in some embodiments there may be three (or more) fluids involved in the creation of droplets: e.g., a first, continuously-flowing fluid that is separated to form discrete droplets (e.g., fluid 21 in FIG. 1), which may also be referred to herein as the "dispersable fluid"; a plurality of droplets of a second fluid that are inserted into the first fluid to cause the first fluid to form droplets (e.g., fluid 23 in FIG. 1), which may also be referred to herein as the "insertion fluid"; and a third, continuously-flowing fluid containing the droplets of second fluid prior to their insertion into the first fluid (e.g., fluid 25 in FIG. 1), which may also be referred to herein as the "continuous fluid." This third fluid is also referred to as the continuous fluid because, at the end of the droplet-formation process, the first fluid and the second fluid are typically present as discrete droplets contained within the continuous fluid.

Thus, as described, one set of embodiments is generally directed to the insertion of a plurality of droplets (or bubbles) of a second fluid into a continuous stream of a first fluid, which may disrupt or disperse the first fluid, thereby causing the continuous stream of first fluid to break up to form discrete droplets. The first or "dispersable" fluid may be a liquid or a gas. In some embodiments, a continuous stream of first fluid may be introduced (e.g., into a junction) at relatively high linear flow rates, for example such that the continuous stream of first fluid exhibits jetting behavior, and/or has a Capillary number of greater than about 1 and/or a Weber number (We) of less than about 1.

Typically, when a fluid exhibits jetting behavior, the inertial forces of the fluid exceed surface tension forces, and thus, the fluid flows as a "jet." In some cases, the jet, if left undisturbed (i.e., in the absence of any additional fluids that interact with the jet, e.g., in the absence of any insertion of droplets into the jet), may eventually break up to form droplets due to Rayleigh-Plateau instability, e.g., at a point relatively far away from the entry of the jetting fluid into a channel, although this does not always occur. In contrast, when a fluid exhibits "dripping" behavior, surface tension forces predominate, which cause the fluid to form individual droplets, for example, upon entry into a channel.

Accordingly, in some cases, a jetting fluid may flow at a relatively high linear flow rate. For example, the linear flow rate of the first fluid within a channel may be at least about 0.1 micrometers/s, at least about 0.2 micrometers/s, at least about 0.3 micrometers/s, at least about 0.5 micrometers/s, at least about 1 micrometer/s, at least about 3 micrometers/s, at least about 5 micrometers/s, at least about 10 micrometer/s, at least about 30 micrometers/s, at least about 50 micrometers/s, at least about 100 micrometer/s, at least about 300 micrometers/s, at least about 500 micrometers/s, at least about 1 mm/s, at least about 3 mm/s, at least about 5 mm/s, at least about 10 mm/s, at least about 30 mm/s, or at least about 50 mm/s.

In certain embodiments, the first fluid (or dispersable fluid) may flow in a channel under conditions such that the fluid exhibits a Capillary number (Ca) that is at least about 1, and/or such that the Weber number (We) is less than about 1. For example, the first fluid may flow under conditions such as these upon entering a microfluidic channel, or at a location where droplets of a second fluid are inserted into the first fluid. Generally, the Capillary number represents the relative effect of viscous forces versus surface tension of a fluid flowing through a channel, while the Weber number represents the inertial forces of the fluid compared to its surface tension forces. The Capillary number and/or the Weber number can be controlled in certain embodiments, for instance, by controlling the speed of fluid within the channel and/or the shape or size of the channel, e.g., its average cross-sectional dimension.

The Capillary number (Ca) can be defined as:

$$Ca \stackrel{def}{=} \frac{\mu V}{\gamma},$$

where μ (mu) is the dynamic viscosity of the fluid, V is the velocity (or linear flow rate) of the fluid, and γ (gamma) is the surface or interfacial tension of the fluid in the channel. In some embodiments, Ca of the first fluid may be at least about 3, at least about 10, at least about 30, at least about 100, at least about 300, or at least about 1000.

As mentioned, the Weber number (We) can be thought of as the balance or ratio between inertial effects (which keeps the fluid coherent) and surface tension effects (which causes the fluid to tend to form droplets). The Weber number is often expressed as a dimensionless ratio of surface tension effects divided by inertial effects, i.e., when the Weber number is greater than 1, surface tension effects dominate, and when the Weber number is less than 1, inertial effects dominate. Thus, the "Weber number" can be defined as:

$$We = \frac{\rho v^2 l}{\sigma},$$

where ρ (rho) is the density of the fluid, v is its velocity, l is its characteristic length (typically the droplet diameter), and σ (sigma) is the surface tension. In some embodiments, We may be less than about 0.3, less than about 0.1, less than about 0.03, less than about 0.01, less than about 0.003, or less than about 0.001, i.e., such that inertial effects dominate.

The use of jetting fluids, or fluids exhibiting high Capillary numbers and/or low Weber numbers during flow, may allow droplets of a first fluid to be created very rapidly in accordance with certain embodiments. In some cases, the droplet creation rate may exceed the droplet creation rates of other techniques (although in other cases, lower droplet creation rates may be used). For example, the rate of creation of droplets (e.g., from a jetting stream of a first fluid) may be at least about 5,000 droplets/s, at least about 10,000 droplets/s, at least about 15,000 droplets/s, at least about 17,000 droplets/s, at least about 19,000 droplets/s, at least about 20,000 droplets/s, at least about 25,000 droplets/s, at least about 30,000 droplets/s, at least about 50,000 droplets/s, at least about 60,000 droplets/s, at least about 70,000 droplets/s, or at least about 100,000 droplets/s. In some embodiments, droplets of a second fluid may be inserted into a continuously flowing first fluid stream to cause the first fluid stream to form discrete droplets without substantially altering the linear flow rate of the first fluid stream. In addition, in certain embodiments, the linear flow rate may be altered by no more than about 25%, no more than about 15%, no more than about 10%, no more than about 5%, etc., relative to its initial flow rate.

The droplets of first fluid that are produced using techniques such as those described herein, in certain embodiments, may have an average dimension or diameter of less than about 1 mm, less than about 500 micrometers, less than about 300 micrometers, less than about 200 micrometers, less than about 100 micrometers, less than about 75 micrometers, less than about 50 micrometers, less than about 30 micrometers, less than about 25 micrometers, less than about 10 micrometers, less than about 5 micrometers, less than about 3 micrometers, or less than about 1 micrometer in some cases. The average diameter may also be at least about 1 micrometer, at least about 2 micrometers, at least about 3 micrometers, at least about 5 micrometers, at least about 10 micrometers, at least about 15 micrometers, or at least about 20 micrometers in certain instances. The droplets may be spherical or non-spherical. The average diameter of a droplet, if the droplet is non-spherical, may be taken as the diameter of a perfect sphere having the same volume as the non-spherical droplet.

In some cases, the droplets of first fluid may be substantially monodisperse, or the droplets may have a homogenous distribution of diameters, e.g., the droplets may have a distribution of diameters such that no more than about 10%, no more than about 5%, no more than about 3%, no more than about 2%, or no more than about 1% of the droplets have a diameter less than about 90% (or less than about 95%, less than about 97%, or less than about 99%) and/or greater than about 110% (or greater than about 101%, greater than about 103%, or greater than about 105%) of the overall average diameter of the plurality of droplets. In some embodiments, the plurality of droplets have an overall average diameter and a distribution of diameters such that the coefficient of variation of the cross-sectional diameters of the droplets is less than about 10%, less than about 5%, less than about 2%, between about 1% and about 10%, between about 1% and about 5%, or between about 1% and about 2%. The coefficient of variation may be defined as the standard deviation divided by the mean, and can be determined by those of ordinary skill in the art.

In one set of embodiments, the first (or dispersable) fluid may itself comprise more than one fluid. For example, the first fluid may comprise two, three, four, or more fluids therein. Upon insertion of droplets of second fluid, some or all of these fluids may exhibit jetting behavior, and/or the first fluid may exhibit a Capillary number of greater than about 1 and/or a Weber number (We) of less than about 1, as discussed above. In one set of embodiments, two or more of these fluids may be present in a "core/shell" arrangement, e.g., where one fluid is partially or completely surrounded by another fluid. Other arrangements are also possible in other embodiments, e.g., where the fluids are positioned side-by-side. The insertion of droplets of second fluid may cause the two or more fluids to form discrete droplets containing some or all of these fluids. In some cases, the fluids may remain as separate fluids within the droplets, for example, in a core/shell arrangement, thereby forming a double emulsion comprising a core fluid, surrounded by a shell fluid, which in turn is contained within a third fluid. Other arrangements are also possible in other embodiments of the invention, e.g., triple emulsions, or other higher level multiple emulsions. In still other embodiments, however, some or all of the fluids within the droplet may mix together and/or react.

As mentioned, a second or "insertion" fluid may be inserted into a continuously-flowing first fluid stream to cause the first fluid stream to from discrete droplets. The second fluid may be inserted into the first fluid stream as a plurality of droplets or bubbles, and may comprise a liquid and/or a gas. The droplets of second fluid may also be substantially monodisperse in certain embodiments, or the droplets of second fluid may have a homogenous distribution of diameters. The second fluid can be substantially immiscible with the first fluid in certain embodiments of the invention, although in other embodiments, the second fluid and the first fluid are not substantially immiscible. For example, under certain conditions, the rate at which the first fluid stream is dispersed to form discrete droplets of first fluid, upon insertion of droplets of the second fluid, is sufficiently fast that the first and second fluids do not have time to substantially mix before discrete droplets of the first fluid are formed.

As discussed, the droplets of second fluid may be substantially monodisperse in some embodiments, or the droplets of second fluid may have a homogenous distribution of diameters. For example, the droplets of second fluid may have a distribution of diameters such that no more than about 10%, no more than about 5%, no more than about 3%, no more than about 2%, or no more than about 1% of the droplets have a diameter less than about 90% (or less than about 95%, less than about 97%, or less than about 99%) and/or greater than about 110% (or greater than about 101%, greater than about 103%, or greater than about 105%) of the overall average diameter of the plurality of droplets of second fluid. In some embodiments, the plurality of droplets of the second fluid have an overall average diameter and a distribution of diameters such that the coefficient of variation of the cross-sectional diameters of the droplets is less than about 10%, less than about 5%, less than about 2%, between about 1% and about 10%, between about 1% and about 5%, or between about 1% and about 2%.

In some cases, the droplets of second fluid may have an average dimension or diameter of less than about 1 mm, less than about 500 micrometers, less than about 300 micrometers, less than about 200 micrometers, less than about 100 micrometers, less than about 75 micrometers, less than about 50 micrometers, less than about 30 micrometers, less than about 25 micrometers, less than about 10 micrometers, less than about 5 micrometers, less than about 3 micrometers, or less than about 1 micrometer in some cases. The average diameter may also be at least about 1 micrometer, at least about 2 micrometers, at least about 3 micrometers, at least about 5 micrometers, at least about 10 micrometers, at least about 15 micrometers, or at least about 20 micrometers in certain instances. The droplets may be spherical or non-spherical. In certain embodiments, the rate of production and/or distribution of sizes of droplets of the first fluid may be controlled, at least in part, by the rate of production and/or the distribution of sizes of droplets of the second fluid.

In some embodiments, the droplets of second fluid may be inserted into the first fluid at a relatively constant rate, and in some cases, at relatively high rate. For example, the droplets may be inserted at a rate of at least about 5,000 droplets/s, at least about 10,000 droplets/s, at least about 15,000 droplets/s, at least about 20,000 droplets/s, at least about 30,000 droplets/s, at least about 50,000 droplets/s, at least about 70,000 droplets/s, or at least about 100,000 droplets/s. As discussed, the rate of insertion of droplets of the second fluid into a continuously-flowing stream of first fluid may control, at least in part, the rate of production of droplets of first fluid from the continuously-flowing stream.

In some embodiments, the droplets or bubbles of the second fluid may be contained in another, third fluid, which eventually forms the continuous fluid containing droplets of first fluid and/or droplets of second fluid. The continuous fluid may be substantially immiscible with one or both of the first fluid and the second fluid in certain embodiments of the invention, as discussed below. However, in other embodiments, these fluids need not all be substantially mutually immiscible. For example, as noted above, the rate at which a first fluid is dispersed or disrupted to form discrete droplets upon insertion of droplets of a second fluid into a continuously-flowing stream of the first fluid may be sufficiently fast such that the first, second, and third fluids do not have time to substantially mix before discrete droplets of the first fluid are formed.

In some embodiments, the third fluid may flow at relatively high linear flow rates. For example, the third fluid may exhibit jetting behavior at the point at which droplets of second fluid are inserted into the first fluid. In some embodiments, the linear flow rate of the third fluid within a channel may be at least about 0.1 micrometers/s, at least about 0.2 micrometers/s, at least about 0.3 micrometers/s, at least about 0.5 micrometers/s, at least about 1 micrometer/s, at least about 3 micrometers/s, at least about 5 micrometers/s, at least about 10 micrometer/s, at least about 30 micrometers/s, at least about 50 micrometers/s, at least about 100 micrometer/s, at least about 300 micrometers/s, at least about 500 micrometers/s, at least about 1 mm/s, at least about 3 mm/s, at least about 5 mm/s, at least about 10 mm/s, at least about 30 mm/s, or at least about 50 mm/s. In other embodiments, however, the third fluid may not necessarily flow at such high flow rates, and may be slower than any of the values described above. In addition, the linear flow rates of the third fluid and the first fluid, at the point at which droplets of second fluid are inserted into the first fluid, may be the same or different.

As mentioned, the first fluid, the second fluid, and the third fluid may be substantially mutually immiscible in certain embodiments of the invention. One non-limiting example of a system involving three substantially mutually immiscible fluids is a system in which the two of the fluids are liquids (e.g., substantially immiscible liquids), while the third fluid is a gas. For example, the second fluid may be present as a gas, while the first fluid and the third fluid may each be liquids.

In some embodiments, the first fluid may be hydrophilic or aqueous, while the second fluid may be hydrophobic or an "oil," or vice versa. Typically, a "hydrophilic" fluid is one that is miscible with pure water, while a "hydrophobic" fluid is a fluid that is not miscible with pure water. It should be noted that the term "oil," as used herein, merely refers to a fluid that is hydrophobic and not miscible in water. Thus, the oil may be a hydrocarbon in some embodiments, but in other embodiments, the oil may be (or include) other hydrophobic fluids (for example, octanol). It should also be noted that the hydrophilic or aqueous fluid need not be pure water. For example, the hydrophilic fluid may be an aqueous solution, for example, a buffer solution, a solution containing a dissolved salt, or the like. A hydrophilic fluid may also be, or include, for example, ethanol or other liquids that are miscible in water, e.g., instead of or in addition to water.

However, the first fluid, the second fluid, and the third fluid are not limited to only systems where one is a gas and the other two are liquids. Other fluid arrangements are also possible, for instance, where all three fluids are liquids. As a non-limiting example, another system of three substantially mutually immiscible liquids is a silicone oil, a mineral oil, and an aqueous solution (i.e., water, or water containing one or more other species that are dissolved and/or suspended therein). Still another example of a system is a silicone oil, a fluorocarbon oil, and an aqueous solution. Yet another example of a system is a hydrocarbon oil (e.g., hexadecane), a fluorocarbon oil, and an aqueous solution. Non-limiting examples of suitable fluorocarbon oils include HFE7500, octadecafluorodecahydronaphthalene:

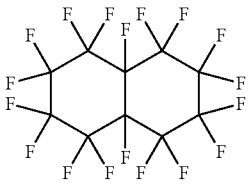

or 1-(1,2,2,3,3,4,4,5,5,6,6-undecafluorocyclohexyl)ethanol:

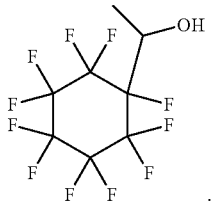

In some cases, after discrete droplets of a first fluid have been formed in a third fluid by insertion of droplets of a second fluid into a continuously-flowing stream of the first fluid, some or all of the second fluid may be removed or separated from the third fluid. The second fluid may be present as droplets or bubbles, or in some cases, some or all of the second fluid may coalesce. Examples of techniques that can be used to remove the second fluid include, but are not limited to, filtration, sedimentation, or buoyancy. As an example, the third fluid may be exposed to centrifugal forces to cause the separation of at least some of the second fluid. As another example, density differences may cause separation of the second fluid to occur (e.g., by rising or sinking relative to the third fluid), for example, if the fluids are allowed to remain substantially undisturbed. For example, if the second fluid is a gas, density differences or buoyancy forces may cause at least some of the second fluid to rise or even exit the third fluid. As still another example, hydrodynamic sorting techniques may be used to remove or separate at least some of the second fluid from the third fluid. In some cases, differences in the hydrodynamic properties of the second fluid relative to the first fluid and/or the third fluid may be used to cause separation to occur. For instance, differences in viscosity, density, volume, surface area, diameter, etc. may be used to cause separation to occur, e.g., under flow conditions. Thus, for instance, under laminar flow, droplets of one fluid may flow faster or slower than droplets of another fluid, which can thereby be used to separate the droplets. Additional non-limiting examples of such sorting techniques may be seen in International Patent Application No. PCT/US2004/027912, filed Aug. 27, 2004, entitled "Electronic Control of Fluidic Species," by Link, et al., published as WO 2005/021151 on Mar. 10, 2005, each incorporated herein by reference.

Other aspects of the present invention are generally directed to microfluidic systems and methods for causing a continuous fluid stream to form discrete droplets, for example, as previously discussed. For instance, in one set of embodiments, a microfluidic device may be used to produce discrete droplets by inserting droplets or bubbles of a fluid into a continuous fluid stream to cause the continuous fluid stream to form discrete droplets. In some cases, the microfluidic device may include a junction of channels, e.g., a junction of a first inlet microfluidic channel, a second inlet microfluidic channel, and an outlet microfluidic channel. The first microfluidic channel may introduce a first fluid (which may be continuous, and may exhibit jetting behavior in some cases), and the second microfluidic channel may introduce a second fluid (for example, as a plurality of droplets contained within a continuous third fluid). At the junction, the droplets of the second fluid may be inserted into the continuous stream of first fluid to cause the continuous stream of first fluid to form discrete droplets. The fluids from the first and second microfluidic channels may exit the junction through the outlet microfluidic channel.

In some cases, the first channel may intersect the second channel at the junction at an angle. Such an angle may be useful, e.g., to allow insertion of the droplets of second fluid to occur without substantially disrupting flow of the first fluid. Thus, for instance, the insertion may occur such that the linear flow rate of the first fluid stream is not substantially altered, or such that the linear flow rate of the first fluid stream is altered by no more than about 25%, no more than about 15%, no more than about 10%, no more than about 5%, etc. In one set of embodiments, the angle between the first channel and the second channel at the junction is less than about 60°, less than about 45°, less than about 40°, less than about 35°, less than about 30°, less than about 25°, or less than about 20°. A non-limiting example of such a configuration is shown in FIG. 1.

Upstream of the junction (e.g., upstream of the channel containing droplets of second fluid, e.g., in a third, continuous fluid) may be another, second junction of channels such as microfluidic channels. In some cases, the second junction is used to create the droplets of second fluid in the third fluid. The second junction may include inlet channels for introducing the second fluid and the third fluid to the junction, as well as an outlet channel (e.g., in fluid communication with the first junction, as previously discussed). Thus, for example, the second junction may comprise two, three, or more inlet channels, and one (or more) outlet channels. Two or more of the channels may meet at a substantially right angle, or at any other suitable angle. In addition, in some cases, the outlet channel may be substantially linearly positioned relative to one of the inlet channels at the second junction. One or more of the channels may also be microfluidic channels.

Any suitable configuration of channels that can be used to create droplets may be used at the second junction. For instance, the second junction may be a T-junction, a Y-junction, a channel-within-a-channel junction (e.g., in a coaxial arrangement, or comprising an inner channel and an outer channel surrounding at least a portion of the inner channel), a cross (or "X") junction, a flow-focus junction, or any other suitable junction for creating droplets of a second fluid in a third fluid. See, e.g., International Patent Application No. PCT/US2004/010903, filed Apr. 9, 2004, entitled "Formation and Control of Fluidic Species," by Link, et al., published as WO 2004/091763 on Oct. 28, 2004, or International Patent Application No. PCT/US2003/020542, filed Jun. 30, 2003, entitled "Method and Apparatus for Fluid Dispersion," by Stone, et al., published as WO 2004/002627 on Jan. 8, 2004, each incorporated herein by reference in its entirety. In addition, the second junction may be configured and arranged to produce substantially monodisperse droplets.

Additionally, in some embodiments, there may be another junction of channels upstream of the first inlet channel of the first junction. This junction may be used to introduce one or more fluids into the first channel. For example, in one set of embodiments, as previously discussed, the first fluid may comprise two or more fluids in a core/shell arrangement (e.g., where one fluid partially or completely surrounds another fluid flowing within the microfluidic channel), or in other arrangements. Thus, in some cases, this additional junction may be used to position the two or more fluids in the first channel. For example, a channel-within-a-channel junction may be used to create a core/shell arrangement. In some cases, higher order nestings are also possible (e.g., comprising 3, 4, or more nested channels).

In other embodiments, however, other junction arrangements are also possible, e.g., T-junctions, Y-junctions, cross (or "X") junctions, or a flow-focus junctions, such as those described herein or in International Patent Application No. PCT/US2004/010903, filed Apr. 9, 2004, entitled "Formation and Control of Fluidic Species," by Link, et al., published as WO 2004/091763 on Oct. 28, 2004, or International Patent Application No. PCT/US2003/020542, filed Jun. 30, 2003, entitled "Method and Apparatus for Fluid Dispersion," by Stone, et al., published as WO 2004/002627 on Jan. 8, 2004. In addition, in still other embodiments, no such junction may be present.

A variety of materials and methods, according to certain aspects of the invention, can be used to form systems such as those described herein able to produce droplets. In some cases, the various materials selected lend themselves to various methods. For example, various components of the invention can be formed from solid materials, in which the channels can be formed via micromachining, film deposition processes such as spin coating and chemical vapor deposition, laser fabrication, photolithographic techniques, etching methods including wet chemical or plasma processes, and the like. See, for example, *Scientific American,* 248:44-55, 1983 (Angell, et al). In one embodiment, at least a portion of the fluidic system is formed of silicon by etching features in a silicon chip. Technologies for precise and efficient fabrication of various fluidic systems and devices of the invention from silicon are known. In another embodiment, various components of the systems and devices of the invention can be formed of a polymer, for example, an elastomeric polymer such as polydimethylsiloxane ("PDMS"), polytetrafluoroethylene ("PTFE" or Teflon®), or the like.

Different components can be fabricated of the same or different materials. For example, a base portion including a bottom wall and side walls can be fabricated from an opaque material such as silicon or PDMS, and a top portion can be fabricated from a transparent or at least partially transparent material, such as glass or a transparent polymer, for observation and/or control of the fluidic process. Components can be coated so as to expose a desired chemical functionality to fluids that contact interior channel walls, where the base supporting material does not have a precise, desired functionality. For example, components can be fabricated as illustrated, with interior channel walls coated with another material. Material used to fabricate various components of the systems and devices of the invention, e.g., materials used to coat interior walls of fluid channels, may desirably be selected from among those materials that will not adversely affect or be affected by fluid flowing through the fluidic system, e.g., material(s) that is chemically inert in the presence of fluids to be used within the device.

In one embodiment, various components of the invention are fabricated from polymeric and/or flexible and/or elastomeric materials, and can be conveniently formed of a hardenable fluid, facilitating fabrication via molding (e.g. replica molding, injection molding, cast molding, etc.). The hardenable fluid can be essentially any fluid that can be induced to solidify, or that spontaneously solidifies, into a solid capable of containing and/or transporting fluids contemplated for use in and with the fluidic network. In one embodiment, the hardenable fluid comprises a polymeric liquid or a liquid polymeric precursor (i.e. a "prepolymer"). Suitable polymeric liquids can include, for example, thermoplastic polymers, thermoset polymers, or mixture of such polymers heated above their melting point. As another example, a suitable polymeric liquid may include a solution of one or more polymers in a suitable solvent, which solution forms a solid polymeric material upon removal of the solvent, for example, by evaporation. Such polymeric materials, which can be solidified from, for example, a melt state or by solvent evaporation, are well known to those of ordinary skill in the art. A variety of polymeric materials, many of which are elastomeric, are suitable, and are also suitable for forming molds or mold masters, for embodiments where one or both of the mold masters is composed of an elastomeric material. A non-limiting list of examples of such polymers includes polymers of the general classes of silicone polymers, epoxy polymers, and acrylate polymers. Epoxy polymers are characterized by the presence of a three-membered cyclic ether group commonly referred to as an epoxy group, 1,2-epoxide, or oxirane. For example, diglycidyl ethers of bisphenol A can be used, in addition to compounds based on aromatic amine, triazine, and cycloaliphatic backbones. Another example includes the well-known Novolac polymers. Non-limiting examples of silicone elastomers suitable for use according to the invention include those formed from precursors including the chlorosilanes such as methylchlorosilanes, ethylchlorosilanes, phenylchlorosilanes, etc.

Silicone polymers are preferred in one set of embodiments, for example, the silicone elastomer polydimethylsiloxane. Non-limiting examples of PDMS polymers include those sold under the trademark Sylgard by Dow Chemical Co., Midland, Mich., and particularly Sylgard 182, Sylgard 184, and Sylgard 186. Silicone polymers including PDMS have several beneficial properties simplifying fabrication of the microfluidic structures of the invention. For instance, such materials are inexpensive, readily available, and can be solidified from a prepolymeric liquid via curing with heat. For example, PDMSs are typically curable by exposure of the prepolymeric liquid to temperatures of about, for example, about 65° C. to about 75° C. for exposure times of, for example, about an hour. Also, silicone polymers, such as PDMS, can be elastomeric, and thus may be useful for forming very small features with relatively high aspect ratios, necessary in certain embodiments of the invention. Flexible (e.g., elastomeric) molds or masters can be advantageous in this regard.

One advantage of forming structures such as microfluidic structures of the invention from silicone polymers, such as PDMS, is the ability of such polymers to be oxidized, for example by exposure to an oxygen-containing plasma such as an air plasma, so that the oxidized structures contain, at their surface, chemical groups capable of cross-linking to other oxidized silicone polymer surfaces or to the oxidized surfaces of a variety of other polymeric and non-polymeric materials. Thus, components can be fabricated and then oxidized and essentially irreversibly sealed to other silicone polymer surfaces, or to the surfaces of other substrates reactive with the oxidized silicone polymer surfaces, without the need for separate adhesives or other sealing means. In most cases, sealing can be completed simply by contacting an oxidized silicone surface to another surface without the need to apply auxiliary pressure to form the seal. That is, the pre-oxidized silicone surface acts as a contact adhesive against suitable mating surfaces. Specifically, in addition to being irreversibly sealable to itself, oxidized silicone such as oxidized PDMS can also be sealed irreversibly to a range of oxidized materials other than itself including, for example, glass, silicon, silicon oxide, quartz, silicon nitride, polyethylene, polystyrene, glassy carbon, and epoxy polymers, which have been oxidized in a similar fashion to the PDMS surface (for example, via exposure to an oxygen-containing plasma). Oxidation and sealing methods useful in the context of the present invention, as well as overall molding techniques, are described in the art, for example, in an article entitled "Rapid Prototyping of Microfluidic Systems and Polydimethylsiloxane," *Anal. Chem.,* 70:474-480, 1998 (Duffy, et al.), incorporated herein by reference.

In some embodiments, certain microfluidic structures of the invention (or interior, fluid-contacting surfaces) may be formed from certain oxidized silicone polymers. Such surfaces may be more hydrophilic than the surface of an elastomeric polymer. Such hydrophilic channel surfaces can thus be more easily filled and wetted with aqueous solutions.

In one embodiment, a bottom wall of a microfluidic device of the invention is formed of a material different from one or more side walls or a top wall, or other components. For example, the interior surface of a bottom wall can comprise the surface of a silicon wafer or microchip, or other substrate. Other components can, as described above, be sealed to such alternative substrates. Where it is desired to seal a component comprising a silicone polymer (e.g. PDMS) to a substrate (bottom wall) of different material, the substrate may be selected from the group of materials to which oxidized silicone polymer is able to irreversibly seal (e.g., glass, silicon, silicon oxide, quartz, silicon nitride, polyethylene, polystyrene, epoxy polymers, and glassy carbon surfaces which have been oxidized). Alternatively, other sealing techniques can be used, as would be apparent to those of ordinary skill in the art, including, but not limited to, the use of separate adhesives, thermal bonding, solvent bonding, ultrasonic welding, etc.

As mentioned, in some, but not all embodiments, the systems and methods described herein may include one or more microfluidic components, for example, one or more microfluidic channels. The "cross-sectional dimension" of a microfluidic channel is measured perpendicular to the direction of fluid flow within the channel. Thus, some or all of the microfluidic channels may have a largest cross-sectional dimension less than 2 mm, and in certain cases, less than 1 mm. In one set of embodiments, the maximum cross-sectional dimension of a microfluidic channel is less than about 500 micrometers, less than about 300 micrometers, less than about 200 micrometers, less than about 100 micrometers, less than about 50 micrometers, less than about 30 micrometers, less than about 10 micrometers, less than about 5 micrometers, less than about 3 micrometers, or less than about 1 micrometer. In certain embodiments, the microfluidic channels may be formed in part by a single component (e.g. an etched substrate or molded unit). Of course, larger channels, tubes, chambers, reservoirs, etc. can also be used to store fluids and/or deliver fluids to various components or systems in other embodiments of the invention.

A microfluidic channel can have any cross-sectional shape (circular, oval, triangular, irregular, square or rectangular, or the like) and can be covered or uncovered. In embodiments where it is completely covered, at least one portion of the channel can have a cross-section that is completely enclosed, or the entire channel may be completely enclosed along its entire length with the exception of its inlet(s) and/or outlet(s). A channel may also have an aspect ratio (length to average cross sectional dimension) of at least 2:1, more typically at least 3:1, 5:1, 10:1, 15:1, 20:1, or more.

In some embodiments, at least a portion of one or more of the channels may be hydrophobic, or treated to render at least a portion hydrophobic. For example, one non-limiting method for making a channel surface hydrophobic comprises contacting the channel surface with an agent that confers hydrophobicity to the channel surface. For example, in some embodiments, a channel surface may be contacted (e.g., flushed) with Aquapel® (a commercial auto glass treatment) (PPG Industries, Pittsburgh, Pa.). In some cases, a channel surface contacted with an agent that confers hydrophobicity may be subsequently purged with air. In some embodiments, the channel may be heated (e.g., baked) to evaporate solvent that contains the agent that confers hydrophobicity.

Thus, in some aspects of the invention, a surface of a microfluidic channel may be modified to facilitate the production of emulsions such as multiple emulsions. In some cases, the surface may be modified by coating a sol-gel onto at least a portion of a microfluidic channel. As an example, the sol-gel coating may be made more hydrophobic by incorporating a hydrophobic polymer in the sol-gel. For instance, the sol-gel may contain one or more silanes, for example, a fluorosilane (i.e., a silane containing at least one fluorine atom) such as heptadecafluorosilane, or other silanes such as methyltriethoxy silane (MTES) or a silane containing one or more lipid chains, such as octadecylsilane or other $CH_3(CH_2)_n$-silanes, where n can be any suitable integer. For instance, n may be greater than 1, 5, or 10, and less than about 20, 25, or 30. The silanes may also optionally include other groups, such as alkoxide groups, for instance, octadecyltrimethoxysilane. In general, most silanes can be used in the sol-gel, with the particular silane being chosen on the basis of desired properties such as hydrophobicity. Other silanes (e.g., having shorter or longer chain lengths) may also be chosen in other embodiments of the invention, depending on factors such as the relative hydrophobicity or hydrophilicity desired. In some cases, the silanes may contain other groups, for example, groups such as amines, which would make the sol-gel more hydrophilic. Non-limiting examples include diamine silane, triamine silane, or N-[3-(trimethoxysilyl)propyl]ethylene diamine silane. The silanes may be reacted to form oligomers or polymers within the sol-gel, and the degree of polymerization (e.g., the lengths of the oligomers or polymers) may be controlled by controlling the reaction conditions, for example by controlling the temperature, amount of acid present, or the like. In some cases, more than one silane may be present in the sol-gel. For instance, the sol-gel may include fluorosilanes to cause the resulting sol-gel to exhibit greater hydrophobicity, and/or other silanes (or other compounds) that facilitate the production of polymers. In some cases, materials able to produce $SiO_2$ compounds to facilitate polymerization may be present, for example, TEOS (tetraethyl orthosilicate). It should be understood that the sol-gel is not limited to containing only silanes, and other materials may be present in addition to, or in place of, the silanes. For instance, the coating may include one or more metal oxides, such as $SiO_2$, vanadia ($V_2O_5$), titania ($TiO_2$), and/or alumina ($Al_2O_3$).

In some instances, the microfluidic channel is constructed from a material suitable to receive the sol-gel, for example, glass, metal oxides, or polymers such as polydimethylsiloxane (PDMS) and other siloxane polymers. For example, in some cases, the microfluidic channel may be one in which contains silicon atoms, and in certain instances, the microfluidic channel may be chosen such that it contains silanol (Si—OH) groups, or can be modified to have silanol groups. For instance, the microfluidic channel may be exposed to an oxygen plasma, an oxidant, or a strong acid cause the formation of silanol groups on the microfluidic channel.

The following documents are incorporated herein by reference in their entireties: International Patent Application No. PCT/US2004/010903, filed Apr. 9, 2004, entitled "Formation and Control of Fluidic Species," by Link, et al., published as WO 2004/091763 on Oct. 28, 2004; International Patent Application No. PCT/US2003/020542, filed Jun. 30, 2003, entitled "Method and Apparatus for Fluid Dispersion," by Stone, et al., published as WO 2004/002627 on Jan. 8, 2004; International Patent Application No. PCT/US2006/007772, filed Mar. 3, 2006, entitled "Method and Apparatus for Forming Multiple Emulsions," by Weitz, et al., published as WO 2006/096571 on Sep. 14, 2006; International Patent Application No. PCT/US2004/027912, filed Aug. 27, 2004, entitled "Electronic Control of Fluidic Species," by Link, et al., published as WO 2005/021151 on Mar. 10, 2005; and International Patent Application No. PCT/US2007/002063, filed Jan. 24, 2007, entitled "Fluidic Droplet Coalescence," by Ahn, et al., published as WO 2007/089541 on Aug. 9, 2007. In addition, U.S. Provisional Patent Application Ser. No. 61/596,658, filed Feb. 8, 2012, entitled "Droplet Formation using Fluid Breakup," by Abate, et al., is incorporated herein by reference in its entirety.

The following examples are intended to illustrate certain embodiments of the present invention, but do not exemplify the full scope of the invention.

Example 1

This example illustrates a droplet formation mechanism that is not limited by jetting, allowing relatively fast droplet production, in accordance with certain embodiments of the invention.

Microfluidic devices can form emulsions with controlled properties, for example, in which all of the droplets within the emulsion are substantially identical in shape and of a size that can be desirably selected. The controlled properties of these emulsions make them attractive for a range of applications. For example, the droplets can be used as templates by which to synthesize particles with a variety of properties, including spherical colloids, non-spherical microgels, and core-shell capsules. See, e.g., International Patent Application No. PCT/US2006/007772, filed Mar. 3, 2006, entitled "Method and Apparatus for Forming Multiple Emulsions," by Weitz, et al., published as WO 2006/096571 on Sep. 14, 2006, or International Patent Application No. PCT/US2011/028754, filed Mar. 17, 2011, entitled "Melt Emulsification," by Shum, et al., published as WO 2011/116154 on Sep. 22, 2011, each incorporated herein by reference. The droplets can also be used as tiny "test tubes" within which to perform chemical or biological reactions; due to the uniformity of the droplets and their small size, large numbers of reactions can be performed with precision, and/or with a minimal amount of reagent.

Droplet formation can be achieved using either T-junction or flow-focus mechanisms. However, this example illustrates a different droplet formation mechanism that can operate under high flow rates where jetting typically occurs, unlike droplet formation in T-junction or flow-focus mechanisms. To form droplets, as shown in this example, a jet of dispersable fluid (i.e., a fluid that is to be dispersed) in a microfluidic channel is initially formed by flowing the dispersable fluid at a very high flow rate within the channel. In the absence of other forces, the jet is stable and does not typically break up into droplets. However, by forcing air bubbles (or droplets of another suitable fluid) alongside or into the jet and confining both together in a channel, curved regions in the water-oil interface may be created that are unstable due to Rayleigh-Plateau instability. The dispersable fluid between consecutive air bubbles can thereby coalesce to form droplets. By adjusting bubble spacing, the droplet size of the dispersable fluid can be controlled, and by using evenly-spaced air bubbles, substantially monodisperse droplets can be formed. This can also be used in some cases to form single emulsions, or double or other multiple emulsions.

One non-limiting example of such a system is illustrated in FIG. 1. This example shows a microfluidic device 10 comprising a jetting region (or channel) 11 for the creation of a stable jet of the dispersable fluid, a bubbling junction 12 for the formation of substantially monodisperse air bubbles, and junction 14, in which bubbles of air (or another fluid) are squeezed into the jet, causing the jet to break up into discrete droplets. Jetting region 11 and bubbling junction 12 are positioned upstream of junction 14, with their outlets intersecting at junction 14, as shown in FIG. 1.

Dispersable fluid 21 (i.e., the fluid that is to be dispersed) is injected into the inlet of jetting region (or channel) 11, and air 23 and a continuous fluid 25 is injected into bubbling junction 12. This creates a jet of dispersable fluid 21 in jetting region 11 that extends into junction 14, while bubbling junction 12 forms air bubbles that are subsequently inserted into this jet at junction 14. Even though the flow velocities of these fluids may be kept relatively high in some embodiments to enable jetting of dispersable fluid 21, air 23 does not typically exhibit jetting behavior due to its flow characteristics, and thus can form bubbles 27, even at high flow rates of continuous fluid 25 or dispersable fluid 21. For example, due to the low density of air, the inertia of the flow of air may be small even for very high velocities. Additionally, due to the high surface tension of air with liquids, interfacial forces are larger by comparison, enabling faster pinching of the air stream. Combined, these characteristics allow periodic, substantially monodisperse bubble formation at bubbling intersection 12, even at relatively high flow rates.

After bubbles 27 are formed at bubbling junction 12, the bubbles are directed towards junction 14, where the bubbles are forced alongside or in a jet of dispersable fluid 21, as illustrated in FIG. 1. If the bubbles were not present, the jet would be stable due to the very high flow rates, exiting the device without breaking up into droplets. However, the air bubbles deform the jet, creating pinched regions that are unstable to Rayleigh-Plateau instability. When the pinched regions break, the dispersable fluid between consecutive bubbles coalesces to become the droplets. In this example, single emulsions are formed by breaking apart a homogenous jet of dispersable fluid 21, although in other cases, dispersable fluid 21 may not necessarily be homogeneous.

Example 2

This example illustrates the formation of double emulsions in accordance with another embodiment of the invention. The device used in this example was similar to that described in Example 1; however, to form the double emulsions, a crossed channel intersection (not shown) was used for channel 11 as the jetting region. This allowed two fluids to be injected for the creation of a coaxial jet in channel 11. For example, the inner fluid of a double emulsion could be injected into the central inlet, and the middle fluid into the two side inlets. This was used to form a coaxial jet of an inner fluid surrounded by a middle fluid. The coaxial jet then flowed to junction 14, where it was deformed by air bubbles 27 (or other fluid droplets) from channel 17 and pinched or broken up to form double emulsion droplets 31. Higher order emulsions (e.g., triple emulsions, quadruple emulsions, etc.) could similarly be produced using suitable techniques for creating higher-order core/shell fluid streams, and higher-order emulsion droplets.

To investigate the physics of the coaxial jet pinching, movies of the device were recorded with a fast camera. The device was fabricated in poly(dimethylsiloxane) (PDMS) using soft lithography techniques. The device was treated to make it hydrophobic by flushing Aquapel® (comprising certain fluorinated compounds) through the channels, and then baking the device in an oven set to 65° C. for 20 minutes. For double emulsions, octanol was used for the inner phase, water with sodium dodecyl sulfate at 1 wt % was used as the middle phase, and HFE-7500 fluorocarbon oil with the ammonium salt of Krytox® 157 FSL (DuPont, Wilmington, Del.) at 1.8 wt % was used as the outer or continuous phase.

Figure 2:
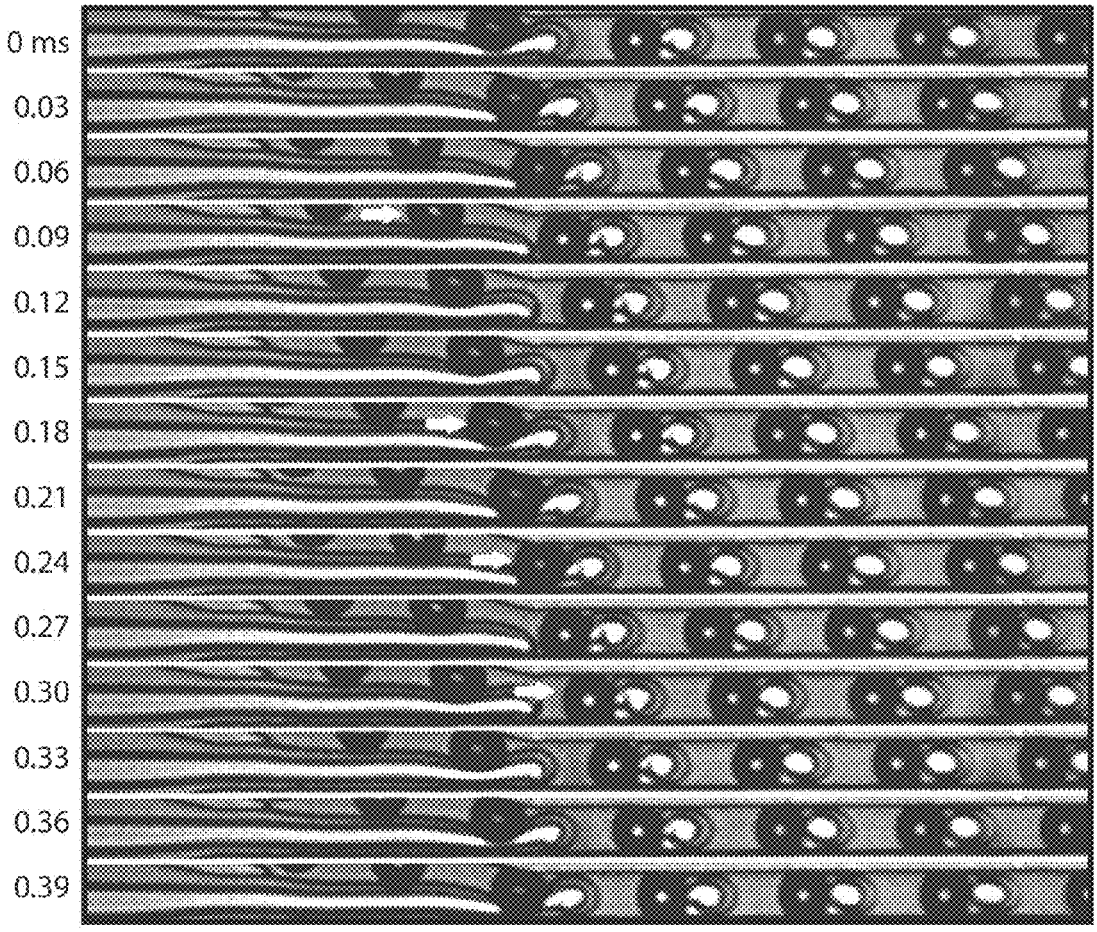
FIG. 2 shows the formation of substantially monodisperse double emulsion droplets, in another embodiment of the invention.

Octanol and water were injected into the central and side inlets of the cross-channel junction, forming a coaxial jet of octanol within water that flowed towards junction 14 (the triggering junction), as shown to the far left for t=0 ms in FIG. 2. Air was injected into the inner-phase inlet of junction 12 (the bubbling junction), and fluorocarbon oil was injected into the continuous phase inlet, forming bubbles 27 that then entered junction 14 through channel 17. As the bubbles approached junction 14, they were forced alongside or into the coaxial jet. Channels 11 and 17 intersect at an angle at the junction, creating sloped walls. This forces the bubbles into the jet gradually, minimizing the stresses on the bubbles, so that they are not sheared apart by the high-velocity flow. The jet deformed as the bubbles were forced alongside it, because it had a lower Laplace pressure than the bubbles, as indicated by the arrows in FIG. 2. The forces involved in this process could be estimated from the curvatures of the jets and bubbles. For the curvatures observed, and known water-oil and air-oil surface tensions, a Laplace pressure of 2.6 kPa was calculated for the bubbles, compared to only 0.6 Pa for the jet; the bubbles were thus less deformable, allowing them to pinch the jet. As each bubble was wedged into the channel, fluid was expelled from the portion of the jet beside it, as shown for t=0.12 to 0.21 ms in FIG. 2; this created a pinched region in the jet with a narrow bridge of liquid connecting two bulges on either side, as shown for t=0.21 and 0.24 ms.

FIG. 2 thus shows the formation of monodisperse double emulsions using bubble-triggered droplet formation, as visualized with a fast camera. In this figure, the bubbles appear as the very dark circles with a bright spot in the center. The octanol, water, and fluorocarbon oil were injected at flow rates of 50, 100, and 400 microliter $h^{-1}$, respectively, and the air was at a pressure of ~140 kPa. The droplet formation frequency was 6.0 kHz. The channel was 25 mm in width, with a square cross section. The arrows follow a single bubble as it pinches off to form a double emulsion droplet.

The pinched geometry was unstable because the uneven curvature of the interface generated a pressure differential in the jet that pumped fluid out of the connecting bridge. As the fluid drains, the bridge gets smaller, and is unstable to the Rayleigh-Plateau instability, eventually causing it to break. The time required for this to happen is an important parameter in this droplet formation mechanism because it determines how long the geometry must be maintained for the pinch off to complete. This, in turn, may limit the maximum rate of droplet formation in some cases.

To estimate the pinch time, the time required for the bridge to drain was calculated. The uneven curvature of the interface created a pressure differential in jet that pumps the fluid out of the connecting bridge. The water-oil surface tension was determined to be ~4 mN $m^{-1}$ with the surfactant. Based on the curvatures of the water-oil interface at the pinch and bulges on either side, a pumping pressure of 1.4 kPa was estimated. This pumping is resisted by the viscous drag of the fluid within the bridge. For Hagen-Poiseuille flow, modeling the bridge as a cylinder with radius of 2 micrometers and a length of 6 micrometers, a hydrodynamic resistance of 2 kg $mm^{-4}$ ms was calculated. For the given pumping pressure, this produced a drainage rate of fluid out of the bridge of about 1 pL $ms^{-1}$. The bridge had a total volume of 0.1 pL, so that an approximate pinch time of 0.1 ms was estimated. This is consistent with the pinch time observed in movies of the process taken with a fast camera, as shown in t=0.24 to 0.30 ms in FIG. 2.

For the breakup to be complete, the pinched geometry must be maintained longer than the pinch time; otherwise, the jet will exit the channel without breaking up into droplets. This time thus limits the maximum rate of droplet formation. For the flow velocities investigated here, the bubble traveled alongside the jet only 32 micrometers over this time; breakup thus occurred almost instantaneously compared to the rest of the flow dynamics. If the velocities were increased sufficiently, however, the bubble could exit the channel before pinch off completed.

Example 3

This example illustrates the production of substantially monodisperse droplets. Like other droplet formation mechanisms, bubble-triggered droplet formation can produce substantially monodisperse droplets, in some cases at faster rates. With bubble-triggered droplet formation, it was also possible to control droplet size because this parameter depends on the volume of fluid partitioned between consecutive bubbles. To characterize the ability to control droplet size, in this example, the bubble spacing was varied and the corresponding droplet sizes were determined. When no bubbles were present, the jet was stable, exiting the device as a continuous, unbroken stream of fluid, as shown for F=0 kHz in FIG. 3. As the air pressure was increased, bubbles began to form at low frequencies. This resulted in a large spacing between bubbles, and long jet plugs, as shown for F=1.9 kHz in FIG. 3. After being pinched off, these plugs pulled themselves into large droplets. As the air pressure was increased, the bubbles were formed more rapidly. The plugs between consecutive bubbles became shorter, resulting in smaller droplets, F=2.8 to 6.0 kHz, FIG. 3. If the air pressure was increased even further, the bubbles entered even more rapidly; at this point, however, the spacing was no longer uniform, and the resulting droplets were more polydisperse, as shown for F=7.4 kHz, FIG. 3.

Figure 3:
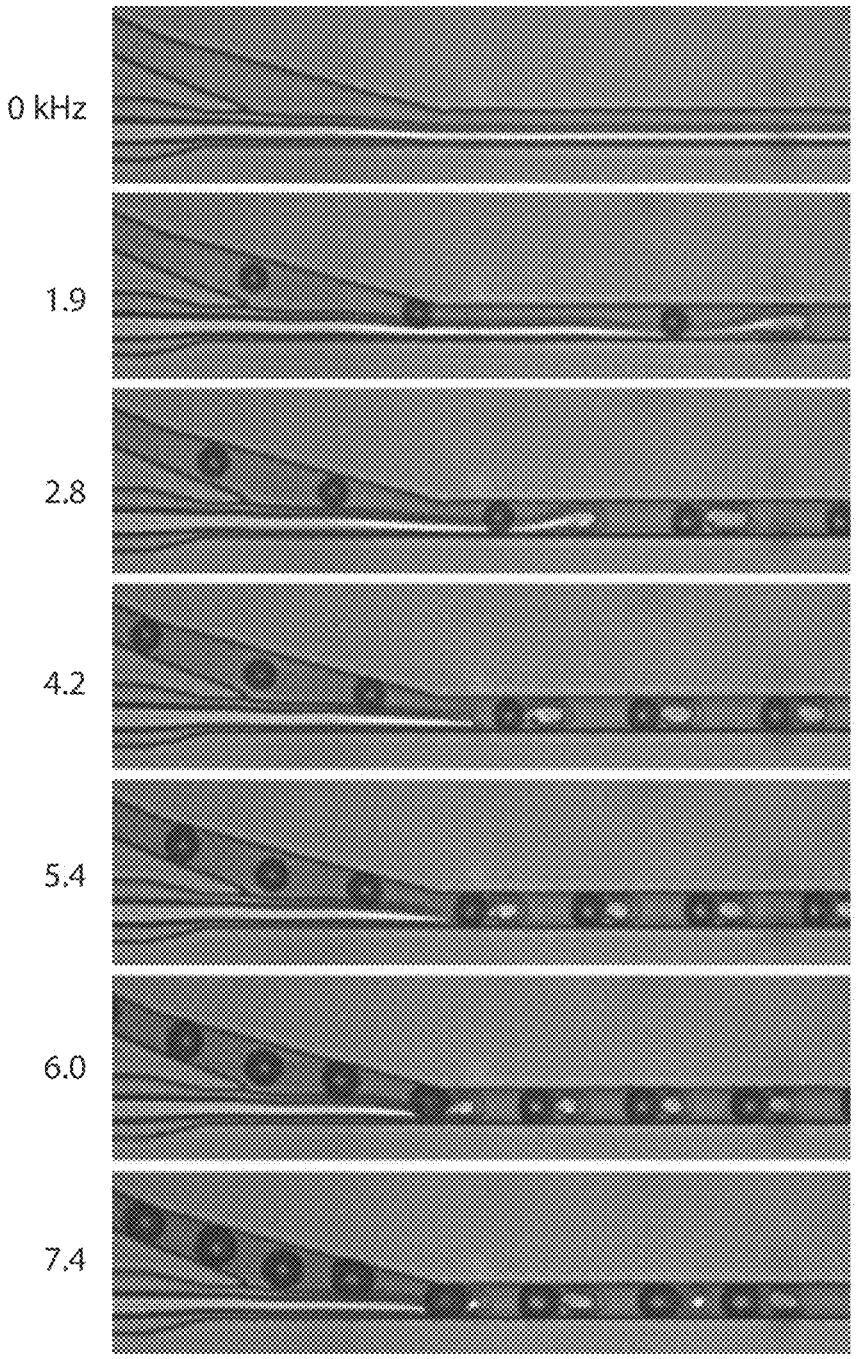
FIG. 3 illustrates different sizes of droplets produced at different droplet formation rates, in still other embodiments of the invention.

Thus, FIG. 3 shows that the size of the droplets that are formed depends, at least in part, on the bubble injection frequency. Slower bubble injection resulted in a long spacing between bubbles, and correspondingly larger droplets, while a faster injection frequency resulted in shorter spacing, and smaller droplets. The octanol, water, and fluorocarbon oil were injected at flow rates of 50, 100, and 400 microliter $h^{-1}$, respectively, and the air pressure was varied between 120 and 145 kPa, as noted above. The channel was 25 micrometer in width, with a square cross section.

This change in behavior at high bubble frequency can be understood by considering the Laplace pressure at the tip of the liquid jet. If the bubbles are introduced too rapidly, there is little time for the tip to extend into the channel before being squeezed by the bubble; consequently, the tip is small and has a large Laplace pressure. This makes the tip harder to deform and, in some instances, may cause the bubble to slide over the tip without pinching off a drop. When the next bubble is injected, a slightly larger droplet will be produced, because it will be composed of the fluid collected over the two bubble cycles. This can lead to alternating sequences of small and large droplets, or polydisperse droplets, as shown for F=7.4 kHz in FIG. 3, which may limit the smallest size of droplets that can be formed. Typically, droplets no smaller than the size of the channel can be formed.

Droplet size may thus be controlled by adjusting bubble spacing, which can, in turn, be controlled with various parameters. For example, for a fixed jet flow rate, reducing bubble frequency increased bubble spacing, leading to larger droplets. Similarly, for a fixed bubble frequency, increasing jet flow rate increased bubble spacing, also leading to larger droplets. Droplet volume thus depended on the product of the dispersable fluid flow rate and bubble period, i.e., $V=(Q_{in}+Q_{mid})T$.

Figure 4:
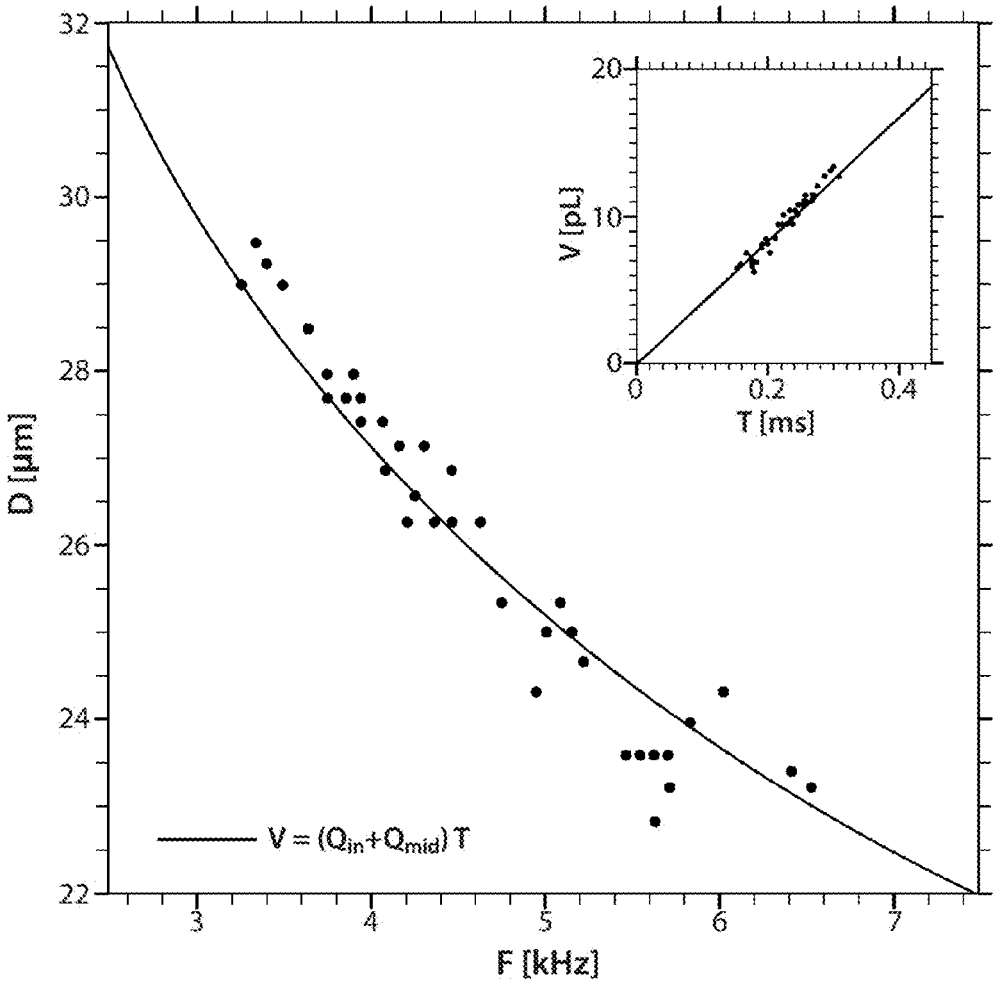
FIG. 4 illustrates droplet diameter as a function of frequency, in yet another embodiment of the invention.

To investigate whether this scaling was correct, the droplet diameter was plotted as a function of the bubble frequency in FIG. 4. The size of the droplets formed depended on the bubble spacing, which could be controlled by adjusting the bubble frequency and the flow velocities of the inner and middle phases. The solid curves in both plots correspond to the scaling predicted by triggered droplet formation. The bubble volume was plotted as a function of the period inset in the figure, for easier comparison with the functional form. In both plots, the droplet size scaling agreed with this functional form, demonstrating that with bubble-triggered droplet formation, droplet size can be controlled.

These examples show that bubble-triggered droplet formation allowed monodisperse droplets to be formed with controlled size, even under jetting flow conditions. This allowed production of substantially monodisperse emulsions at rates much faster than conventional mechanisms, including T-junction and flow-focus mechanisms. Another advantage is that it requires a minimal amount of continuous phase to form the droplets, because a majority of the volume in the continuous phase is occupied by the bubbles, making this a cost-effective droplet formation strategy as well.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A method of producing droplets, comprising:

providing a first continuous fluid stream comprising a first fluid, and a second continuous fluid stream comprising a second fluid and a plurality of insertable microfluidic droplets comprising a third fluid, the plurality of insertable droplets contained within the second fluid; and inserting the plurality of insertable droplets into the first continuous fluid stream at a junction to cause the first continuous fluid stream to break up into discrete droplets of the first fluid, wherein the plurality of the insertable droplets and the discrete droplets exit the junction after the insertion of the plurality of the insertable droplets;

wherein the first continuous fluid stream comprising the first fluid is a fluid jet.

2. The method of claim 1, wherein the first continuous fluid stream has a flow rate such that, in the absence of the insertion of the plurality of insertable droplets, the first continuous fluid stream does not form discrete droplets of first fluid.

3. The method of claim 1, wherein the first continuous fluid stream has a Weber number (We) less than about 1.

4. The method of claim 1, wherein the first continuous fluid stream has a Capillary number (Ca) greater than about 1.

5. The method of claim 1, wherein the plurality of insertable droplets is inserted into the first continuous fluid stream at a rate of least about 15,000 droplets/s.

6. The method of claim 1, wherein the plurality of insertable droplets are inserted into the first continuous fluid stream without substantially altering the linear flow rate of the continuous fluid stream.

7. The method of claim 1, wherein the discrete droplets of the first fluid are substantially monodisperse.

8. The method of claim 1, wherein the insertable droplets are substantially monodisperse.

9. The method of claim 1, wherein the insertable droplets have a distribution in diameters such that no more than about 10% of the insertable droplets have a diameter that is less than about 90% of the overall average diameter of the insertable droplets.

10. The method of claim 1, wherein the first continuous fluid stream further comprises an outer fluid surrounding at least a portion of the first fluid.

11. The method of claim 1, wherein the first fluid, the second fluid, and the third fluid are each substantially mutually immiscible.

12. The method of claim 1, wherein the first fluid and the second fluid are each liquids, and the third fluid is a gas.

13. The method of claim 1, further comprising separating at least some of the third fluid from the first fluid after forming the discrete droplets of first fluid.

14. A method of producing droplets, comprising:

providing a first continuous fluid stream comprising a first fluid and a second continuous fluid stream comprising a second fluid, and a third fluid forming insertable microfluidic droplets within the second fluid; and inserting a plurality of the insertable droplets of the third fluid into the first continuous fluid stream at a junction to cause the first continuous fluid stream to break up into discrete substantially monodisperse droplets of first fluid, wherein the plurality of the insertable droplets and the droplets of the first fluid exit the junction after insertion of the plurality of the insertable droplets;

wherein the first continuous fluid stream comprising the first fluid is a fluid jet.

15. The method of claim 14, wherein the droplets of the first fluid have a distribution in diameters such that no more than about 10% of the droplets of the first fluid have a diameter that is less than about 90% of the overall average diameter of the droplets of the first fluid.

16. The method of claim 14, wherein the third fluid is a gas.

17. A method of producing droplets, comprising:

providing a first continuous fluid stream comprising a first fluid;

providing a second continuous fluid stream comprising a second fluid containing substantially monodisperse droplets of a third fluid; and inserting a plurality of substantially monodisperse droplets of the third fluid into the first continuous fluid stream at a junction to cause the first continuous fluid stream to form discrete droplets of the first fluid, wherein the droplets of the third fluid and the droplets of the first fluid exit the junction after insertion of droplets of the third fluid;

wherein the first continuous fluid stream comprising the first fluid is a fluid jet.

18. The method of claim 17, wherein the third fluid is a gas.

* * * * *